United States Patent [19]

Detilleux et al.

[11] Patent Number: 4,989,824

[45] Date of Patent: Feb. 5, 1991

[54] MOTOR BLOCK FASTENING DEVICE FOR A TRENCHING MACHINE

[75] Inventors: Jean-Claude Detilleux, Les Ulis; Philippe Chagnot, Voulx; Karl Bollinger, Rueil Malmaison; Jean-Pierre Schreiber, Mareil-sur-Mauldre; André Ponsada, Rueil Malmaison, France; Philippe Lefort, Brunoy, all of France

[73] Assignee: Societe Anonyme dite - SOLETANCHE, Nanterre, France

[21] Appl. No.: 438,722

[22] Filed: Nov. 17, 1989

[30] Foreign Application Priority Data

Nov. 18, 1988 [FR] France ..... 88 15022

[51] Int. Cl.[5] ..... F16M 13/00

[52] U.S. Cl. ..... 248/674; 172/40

[58] Field of Search ..... 248/674, 678, 676, 298, 248/637; 172/40

[56] References Cited

U.S. PATENT DOCUMENTS

| | | | |
|---|---|---|---|
| 2,885,165 | 5/1959 | Smolen | 248/124 |
| 4,085,914 | 4/1978 | Gavin | 248/678 |

FOREIGN PATENT DOCUMENTS

| | | | |
|---|---|---|---|
| 0249555 | 12/1987 | European Pat. Off. . | |
| 1056643 | 10/1953 | France | 248/678 |
| 493534 | 4/1954 | Italy | 248/678 |
| 2127721 | 4/1984 | United Kingdom . | |

*Primary Examiner*—Ramon O. Ramirez
*Assistant Examiner*—Robert A. Olson
*Attorney, Agent, or Firm*—Schweitzger Cornman & Gross

[57] ABSTRACT

A cutting machine for cutting trenches in the ground, including a flat bottom face portion for supporting a pair of motor blocks; two motor blocks, with parallel axes, adapted to mount half-drum cutters; each motor block comprising a central vertical keel projecting downwardly from a horizontal top plate; connection means securing each motor block top plate to said bottom face; the inner edge of each top plate being provided with a beveled surface; an abutment member having parallel beveled edges complementary in shaped to the beveled edge of each top plate; means mounting said abutment member to the central portions of said bottom surface; locking means urging the beveled edge of each top plate against the beveled edges of said abutment member.

6 Claims, 2 Drawing Sheets

MOTOR BLOCK FASTENING DEVICE FOR A TRENCHING MACHINE

BACKGROUND OF THE INVENTION

The present invention relates to a new device for fastening blocks on a machine designed to cut trenches in the earth.

Machines are already known which make it possible to cut into the earth trenches of great depth filled with bentonite mud. These machine have on their bottom part two motor blocks each supporting two half-drums with a common shaft, revolving in opposite directions, and provided with teeth which are mounted symmetrically on either side of a vertical supporting keel whose upper part is integral with a horizontal top plate serving to mount the motor block on the bottom part of the trenching machine. The motors are generally situated inside of the half drums.

Such trenching machines require relatively frequent removal of the motor blocks, and this constitutes a great loss of money and time on account of the poor accessibility of the central part of the device between the two motor blocks.

SUMMARY OF THE PRESENT INVENTION

The object of the present invention is a new device for mounting the motor blocks of this type of machine which will enable them to be mounted and removed in a fast and simple manner without adversely affecting the quality of the mounting.

The object of the present invention is a motor block fastening device for a trenching machine of the type having on its bottom part two motor blocks each bearing two coaxial half drums provided with teeth mounted on a central keel surmounted by a horizontal top plate, characterized by the fact that the fixation of the top plate of the central keel to the bottom part of the machine is achieved by the fact that the end of the top plate that is facing toward the center of the machine has on its bottom face a beveled edge which is in engagement with an abutment plate of complementary shape which is affixed to the bottom part of the trenching machine, the said top plate being forcibly thrust toward the center of the machine and being held at its other end against the bottom part of the machine, by means of bolts, for example.

In one particular embodiment of the invention, the bottom part of the trenching machine is constituted by a cast-iron plate having in the center of its bottom face an abutment plate forming abutments for the beveled ends of the motor block top plates.

This cast-iron plate alco has two longitudinal openings disposed in the axis of the motor block keels, and the top plates of the motor blocks have cleats which, when they are assembled, engage the said longitudinal openings.

In one particular embodiment, a bolt disposed in the thickness of the abutment plate permits exerting a sufficient horizontal force on the end of the cleat of the top plate to push the latter toward the abutment plate, while still permitting the vertical bolts to be tightened to join the top plate firmly to the base plate of the machine in the vicinity of the end of the top plate, which is situated on the side of the machine.

To facilitate comprehension of the invention a description will now be given by way of explanation, but without any intention to limit the invention, of an embodiment taken as an example and represented in the appended drawing.

In this drawing:

DETAILED DESCRIPTION OF THE INVENTION

Figure 1:
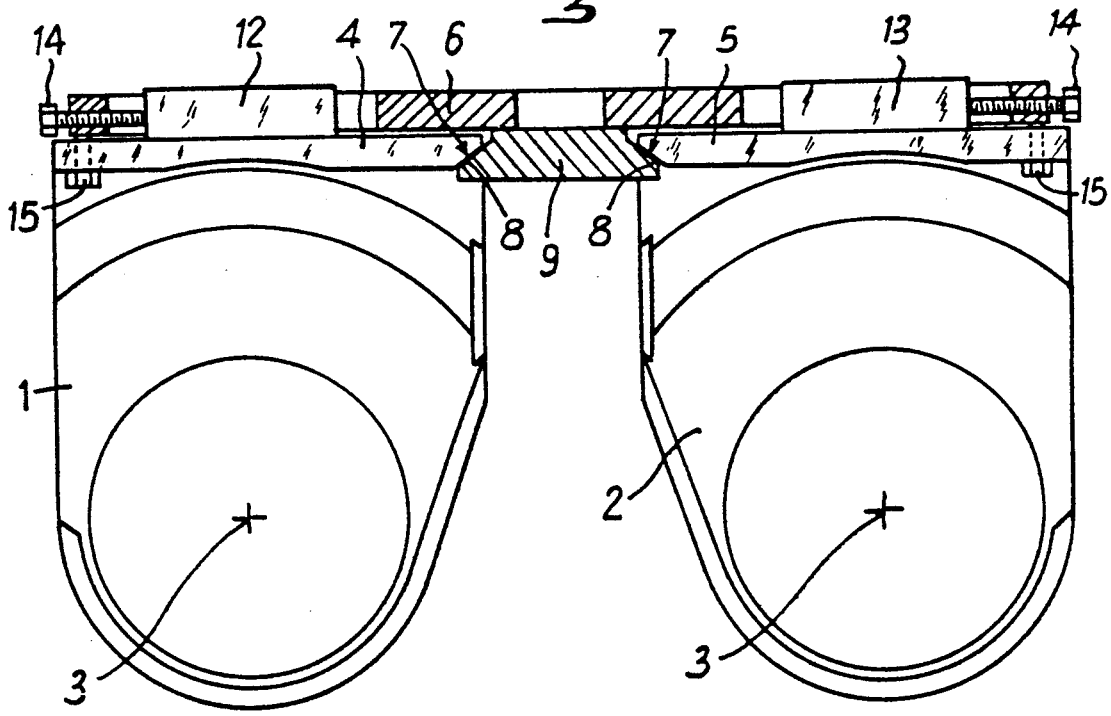
FIG. 1 is a diagrammatic elevation of the two motor blocks fastened on the base plate of the trenching machine.

Diagrammatically represented in the drawing are the central keels 1 and 2, each supporting an assembly constituted by the motor and the cutters which, for the sake of simplicity, are not showh in the drawing.

The cutters are composed of two half-provided with teeth on their periphery, which are driven in rotation about the axes 3 by a motor.

Each keel 1, 2, is equipped at the top with a horizontal top plate 4, 5, which enables the motor block to be affixed to the bottom part of the trenching machine, which is constituted, in the embodiment described, by a steel base plate 6.

In accordance with the invention, the ends 4 and 5 which are pointed toward the center of the machine, have each a bevel 7 which comes into engagement with an abutment 8 of complementary shape made on an abutment plate 9 which is fastened to the bottom part of the base plate 6.

The shape of the surfaces 7 and 8 is such that, whem a top plate 4, 5, is thrust toward the center of the machine, its inside edge will be wedged against the abutment plate while being tightly pressed against the base plate 6.

In the particular embodiment which is represented in the drawing, the base plate 6 constituting the bottom part of the trenching machine has two longitudinal openings 10 and 11 within which are engaged the cleats 12 and 13 made in the top surface of the top plates in the axis of the keels 1 and 2.

The engagement of a cleat 12, 13, in one of the slots 10 and 11 assures the correct positioning of the corresponding motor block, which can nevertheless slide horizontally in the plane of the keel to move toward or away from the center of the trenching machine. At each end of the base plate 6 is a bolt 14 engaged in a threaded horizontal bore such that the end of bolt 14 will thrust against the end of the cleat 12, 13, to push the corresponding motor toward the center of the machine.

At each end of base plate 6 are other bolts 15 whose heads are beneath the top plates 4 and 5 and which pass through the latter through elongated holes 16.

To proceed to the assembly of a motor block, first of all the end 7 of the top plate 4, 5, is brought into engagement with the bevel 8 on the abutment plate 9 while the cleat 12, 13, is engaged in the corresponding opening 10, 11, of the base plate 6, and then by means of the bolts 15 the motor block is temporarily held and thus supported while still being able to shift slightly in the plane of the keel.

Then the bolt 14 is tightened, and pushes the motor block toward the center such that the inside end of top plate 4, 5, is wedged by the action of the inclined surfaces 7 and 8 of the abutment plate 9.

When the horizontal lock-up is thus accomplished, it will suffice to tighten the bolts 15 to assure the complete fixation of the motor block on the base plate of the trenching machine.

Figure 2:
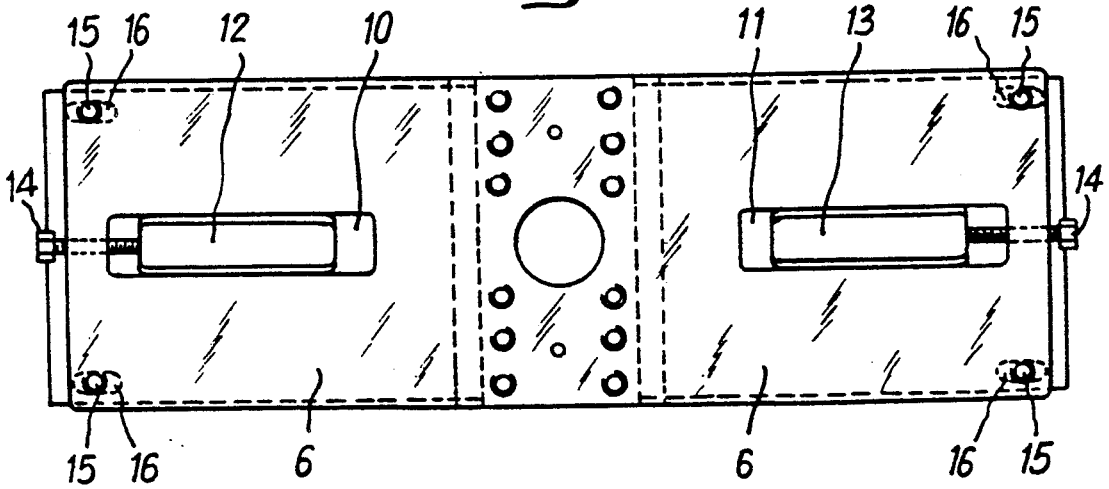
FIG. 2 is a top view of FIG. 1.
Figure 4:
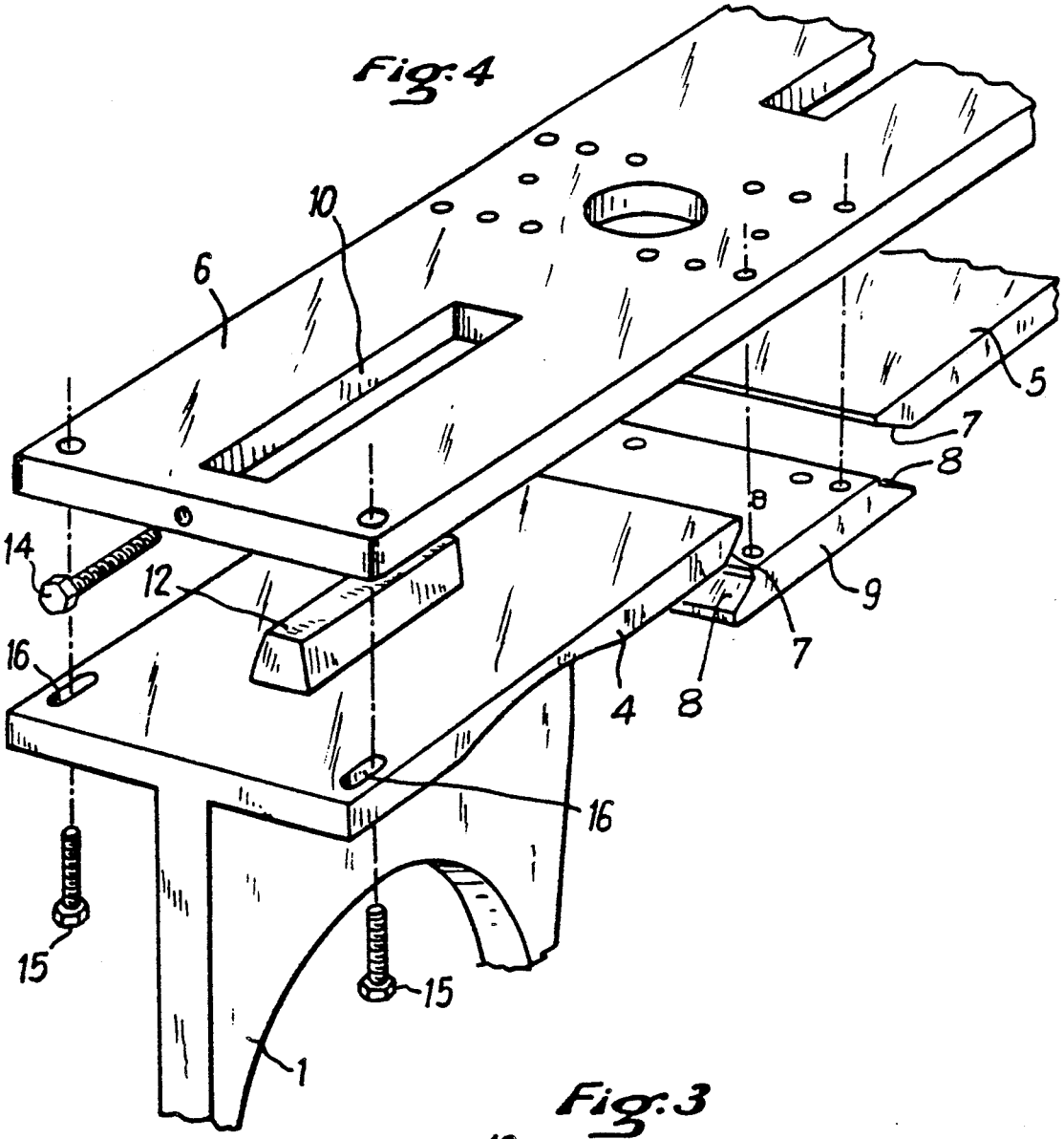
FIG. 4 is a perspective view of the motor block fastening device.
Figure 3:
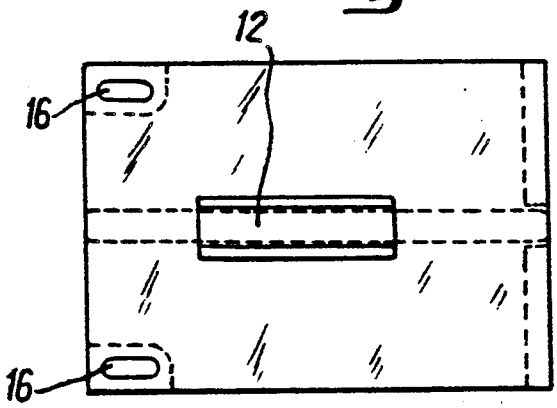
FIG. 3 is a top view of the left motor block top plate of FIG. 1.

The various elements of the invention will be seen in FIG. 4, which is a perspective view corresponding to FIGS. 1 to 3.

In particular it can be seen how the abutment plate 9 provided with bevels 8 is affixed beneath the base plate 6, and how the cleats 12, 13, enter into the openings 10 and 11 to provide guidance for the motor blocks.

Also seen is how the ends of the top plates 4 and 5, which are in the center of the machine, are held only by the wedging action between the beveled portions 7 and 8, while their other end is held by bolts 15 after bolt 14 has thrust the motor block toward the center of the machine.

It will be understood that it is thus possible, in a simple and quick manner, to mount a motor block on the base of the trenching machine by means only of the bolts which are situated on the sides of the machine and without having to do anything at the center thereof.

Contrary to any fears that might have been had on account of the very great vibration and stress to which the cutters of these machines are subjected, this mounting method, has been tested by the applicant company under particularly difficult conditions, has proven to be particularly reliable.

We claim:

1. A cutting machine for cutting trenches in the ground, including (a) a flat bottom face portion for supporting a pair of motor blocks;

(b) two motor blocks, with parallel axes, adapted to mount half-drum cutters;

(c) each motor block comprising a central vertical keel projecting downwardly from a horizontal top plate;

(d) connection means securing each motor top plate to said bottom face;

(e) the inner edge of each top plate being provided with a beveled surface;

(f) an abutment member having parallel beveled edges complementary in shape to the beveled edge of each top plate;

(g) means mounting said abutment member to the central portions of said bottom surface;

(h) locking means urging the beveled edge of each top plate against the beveled edges of said abutment member.

2. The cutting machine of claim 1, in which (a) said connection means are bolts.

3. The cutting machine of claim 2, in which (a) said bottom face is a base plate.

4. The cutting machine of claim 3, in which (a) said base plate defines longitudinal elongated openings disposed in the planes of said vertical keels;

(b) cleat means are included on the top surface of said top plate and are disposed in said openings when said top plate and said base plate are assembled.

5. The cutting machine of claim 4, in which (a) said locking means includes a bolt means and threaded bore means formed in outer portions of said top plate and terminating in said openings;

(b) said bolt means being adapted to exert horizontal locking force on said cleats thereby urging said top plate into firm engagement with said abutment member.

6. The cutting machine of claim 3, in which (a) said top plate defines elongated slots at outer edge portion thereof;

(b) said connection means are bolts extending through said slots into engagement with said base plate.

* * * * *